US010571860B2

(12) United States Patent
Watanabe et al.

(10) Patent No.: US 10,571,860 B2
(45) Date of Patent: Feb. 25, 2020

(54) IMAGE FORMING APPARATUS WITH DEW CONDENSATION ELIMINATION MODES

(71) Applicant: CANON KABUSHIKI KAISHA, Tokyo (JP)

(72) Inventors: Naoto Watanabe, Abiko (JP); Hiroyuki Eda, Moriya (JP); Hidenori Matsumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/208,965

(22) Filed: Dec. 4, 2018

(65) Prior Publication Data

US 2019/0171159 A1 Jun. 6, 2019

(30) Foreign Application Priority Data

Dec. 5, 2017 (JP) ..... 2017-233792

(51) Int. Cl.

| | |
|---|---|
| ***G03G 21/20*** | (2006.01) |
| ***G03G 15/00*** | (2006.01) |
| ***G03G 15/01*** | (2006.01) |
| ***G03G 15/02*** | (2006.01) |

(52) U.S. Cl.

CPC ..... *G03G 21/20* (2013.01); *G03G 15/0105* (2013.01); *G03G 15/0266* (2013.01); *G03G 21/203* (2013.01); *G03G 21/206* (2013.01)

(58) Field of Classification Search

CPC ..... G03G 21/20; G03G 15/0266; G03G 15/033–5045; G03G 15/0178; G03G 15/50

USPC ..... 399/44, 50, 31, 92, 97, 94

See application file for complete search history.

(56) References Cited

U.S. PATENT DOCUMENTS 9,285,701 B2 3/2016 Imanaka et al.

FOREIGN PATENT DOCUMENTS

JP 2010-256823 A 11/2010
JP 2012-141541 A 7/2012

*Primary Examiner* — Walter L Lindsay, Jr.
*Assistant Examiner* — Arlene Heredia
(74) *Attorney, Agent, or Firm* — Venable LLP

(57) ABSTRACT

Consumption of toner can be minimized in a method of performing dew condensation elimination through toner application to a photosensitive drum. To this end, an image forming apparatus includes a plurality of photosensitive drums; an intermediate transfer belt to which toner images are transferred from the plurality of photosensitive drums; a controller configured to determine whether or not a dew condensation occurrence condition is met; and a dew condensation elimination unit configured to perform a dew condensation elimination operation by applying toner to at least one of the plurality of photosensitive drums in a case in which the controller determines that the dew condensation occurrence condition is met and when a start instruction for image formation is received. When the image formation is started in a color image formation mode, the dew condensation elimination unit executes a first dew condensation elimination mode of applying toner to all of the plurality of photosensitive drums. When the image formation is started in a monochromatic image formation mode, the dew condensation elimination unit executes a second dew condensation elimination mode of applying toner to only the black photosensitive drum.

9 Claims, 7 Drawing Sheets

IMAGE FORMING APPARATUS WITH DEW CONDENSATION ELIMINATION MODES

BACKGROUND OF THE INVENTION

Field of the Invention

The present disclosure relates to an image forming apparatus of an electrophotographic type.

Description of the Related Art

There is a case in which dew condensation occurs inside an image forming apparatus due to environmental changes such as a change in temperature of an office in which the image forming apparatus is installed. Occurrence of dew condensation is caused by regional and seasonal factors on the installed image forming apparatus, or is caused by environmental changes such as a steep drop of temperature in the evening or morning or a rapid change in room temperature by start of air-conditioning equipment at beginning of office hours. Prevention of dew condensation caused by such a rapid change in temperature has been demanded for an image forming apparatus.

As a method of eliminating the dew condensation, there has been known the method disclosed in U.S. Pat. No. 9,285,701 (B2). According to the method disclosed in U.S. Pat. No. 9,285,701 (B2), when it is determined that dew condensation occurs, toner is supplied to a photosensitive drum (hereinafter referred to as "toner application"), and the toner removes water droplets adhering to the drum to eliminate the dew condensation on the photosensitive drum.

According to U.S. Pat. No. 9,285,701 (B2), when it is determined that the dew condensation occurs, the toner application is performed to eliminate dew condensation. However, there is a problem in that, when toner application is performed on photosensitive drums for four colors, a large amount of toner is consumed.

SUMMARY OF THE INVENTION

An image forming apparatus according to the present disclosure includes a plurality of photosensitive drums which are configured to bear toner images, the plurality of photosensitive drums including a first photosensitive drum configured to bear a yellow toner image, a second photosensitive drum configured to bear a magenta toner image, a third photosensitive drum configured to bear a cyan toner image, and a fourth photosensitive drum configured to bear a black toner image; an intermediate transfer belt to which the toner images are transferred from the plurality of photosensitive drums; a controller configured to determine whether or not a dew condensation occurrence condition is met; and a dew condensation elimination unit configured to perform a dew condensation elimination operation by applying toner to at least one of the plurality of photosensitive drums and collecting the applied toner in a case in which the controller determines that the dew condensation occurrence condition is met and when an instruction for image formation is received, wherein, in a case in which the dew condensation elimination operation is to be performed when the image formation is started in a color image formation mode, the dew condensation elimination unit executes a first dew condensation elimination mode of applying toner to the first photosensitive drum, the second photosensitive drum, the third photosensitive drum, and the fourth photosensitive drum, wherein, in the case in which the dew condensation elimination operation is to be performed when the image formation is started in a monochromatic image formation mode, the dew condensation elimination unit executes a second dew condensation elimination mode of applying toner to the fourth photosensitive drum without applying toner to the first photosensitive drum, the second photosensitive drum, and the third photosensitive drum, and wherein, when an image formation mode is changed from the monochromatic image formation mode to the color image formation mode after the image formation is started, the dew condensation elimination unit executes a third dew condensation elimination mode of applying toner to the first photosensitive drum, the second photosensitive drum, and the third photosensitive drum, without applying toner to the fourth photosensitive drum.

Further features of the present invention will become apparent from the following description of exemplary embodiments (with reference to the attached drawings).

DESCRIPTION OF THE EMBODIMENTS

Now, embodiments of the present disclosure are described with reference to the drawings. Note that, the following embodiments are not intended to limit the present disclosure defined in the scope of claims, and not all combinations of features described in the embodiments are essential to solving means of the present disclosure.

<Sectional View of Image Forming Apparatus>

Figure 1:
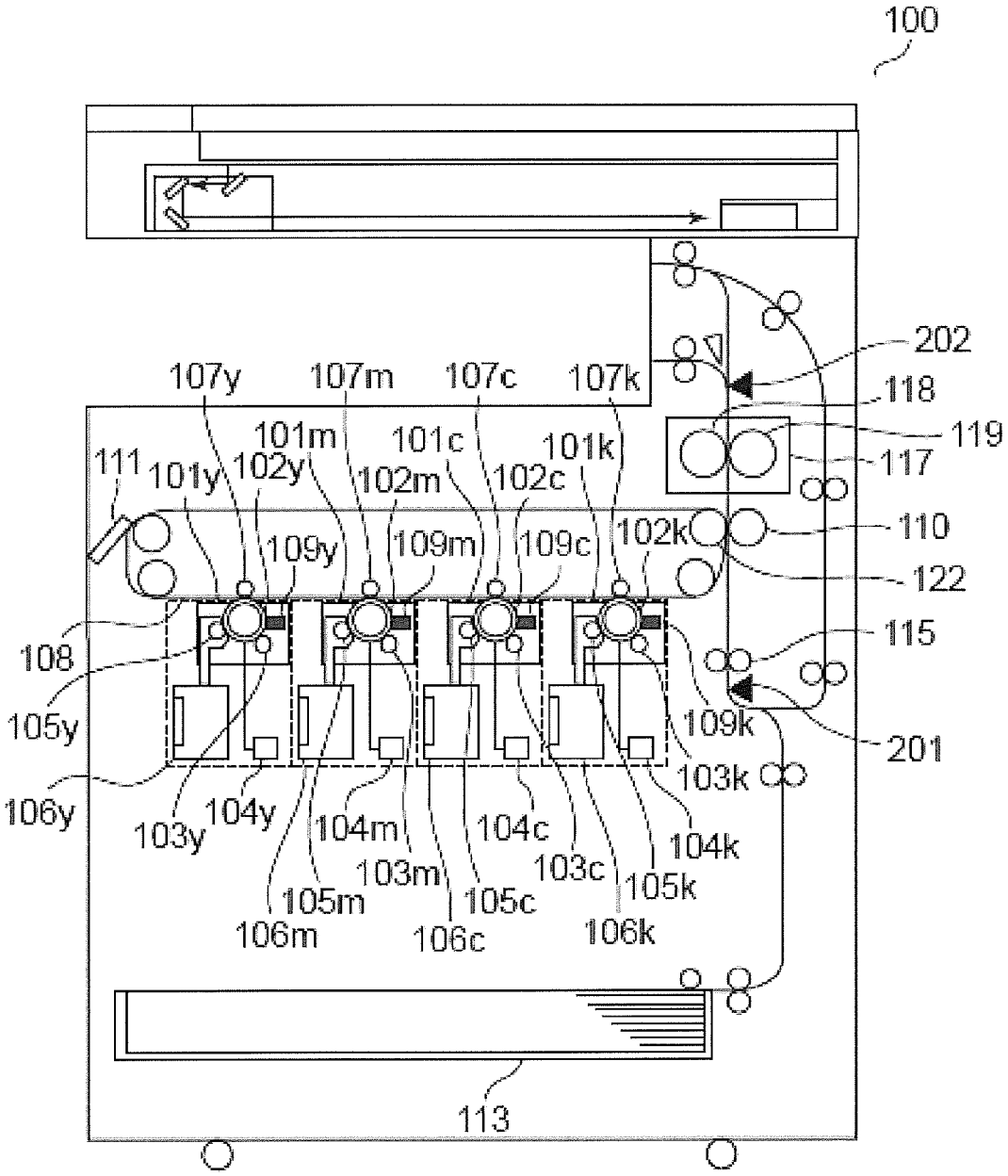
FIG. 1 is a sectional view of an image forming apparatus.

FIG. 1 is a sectional view of an image forming apparatus. An image forming apparatus 100 includes a plurality of process units 101*y*, 101*m*, 101*c*, and 101*k* which are arranged at certain intervals on a substantially horizontal straight line. The process units 101*y*, 101*m*, 101*c*, and 101*k* are configured to form toner images of yellow (y), magenta (m), cyan (c), and black (k) developers, respectively. The toner images formed by the process units 101*y*, 101*m*, 101*c*, and 101*k* are primarily transferred to an intermediate transfer belt 108 held in abutment against the process units 101*y*, 101*m*, 101*c*, and 101*k*. Then, the toner images of respective colors superimposed on the intermediate transfer belt 108 are conveyed, and then are transferred onto a sheet synchronously fed by registration rollers 115 described later at a nip portion at which a drive roller 122 and a secondary transfer roller 110 are held in abutment against each other. The process units 101$y$, 101$m$, 101$c$, and 101$k$ each include a photosensitive drum 102 configured to bear a toner image, a charge roller 103, a laser exposure device 104, a developing device 105, a toner container 106, and an auxiliary charging brush 109. In FIG. 1, characters y, m, c, and k corresponding to the respective colors are added to ends of the reference symbols.

Further, the image forming apparatus 100 includes primary transfer rollers 107$y$ to 107$k$, the intermediate transfer belt 108, the secondary transfer roller 110, and a transfer cleaning device 111. Moreover, the image forming apparatus 100 includes a sheet-feeding cassette 113, the registration rollers 115, a fixing device 117, the drive roller 122, a pre-registration conveyance sensor 201, and a conveyance sensor 202. The fixing device 117 includes a fixing roller 118 and a pressure roller 119. Operations of the components are described later.

<Control Block Diagram>

Figure 2:
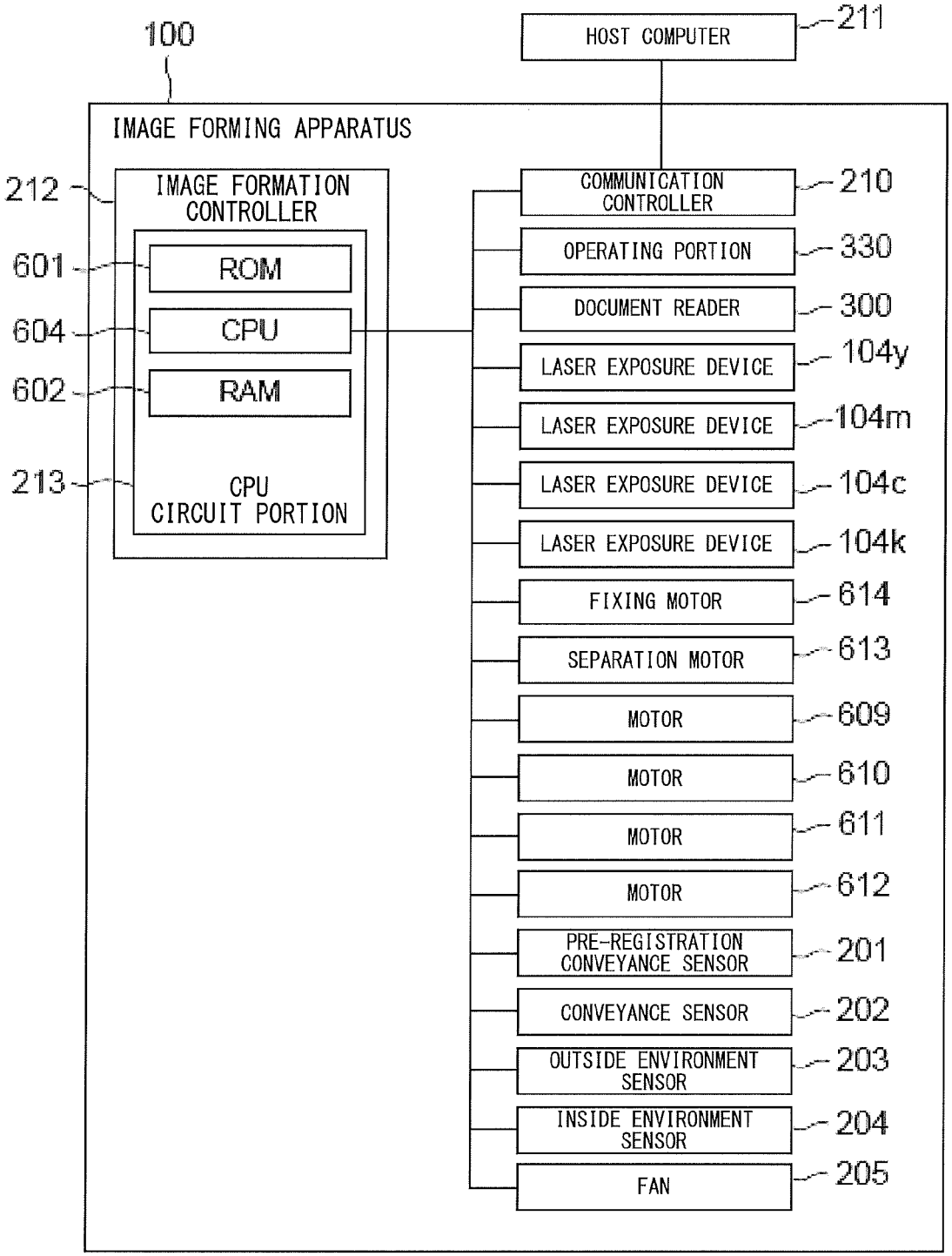
FIG. 2 is a control block diagram of the image forming apparatus.

FIG. 2 is a control block diagram of the image forming apparatus 100. A CPU circuit portion 213 includes a CPU 604, a ROM 601, and a RAM 602, and receives a start instruction for image formation from a host computer 211 through a communication controller 210. After receiving the start instruction for image formation, the CPU circuit portion 213 acquires data of j ob information and stores the data in the RAM 602. Then, in order to perform an image forming operation described later, the CPU circuit portion 213 controls laser exposure devices 104$y$, 104$m$, 104$c$, and 104$k$, motors 609 to 612, a separation motor 613, and a fixing motor 614. The motor 612 is configured to drive a photosensitive drum 102$k$ and a developing device 105$k$ which correspond to black. The motors 609 to 611 are configured to drive photosensitive drums 102$y$, 102$m$, and 102$c$ and developing devices 105$y$, 105$m$, and 105$c$. The separation motor 613 is an abutment/separation unit configured to control abutment and separation of the intermediate transfer belt 108 with respect to the process units 101$y$, 101$m$, 101$c$, and 101$k$. The fixing motor 614 is configured to drive the fixing roller 118 and the pressure roller 119.

In a normal abutment state of the intermediate transfer belt 108 and the process units 101$y$, 101$m$, 101$c$, and 101$k$, in this embodiment, priority is given to a monochromatic image, and hence only the process unit 101$k$ is held in abutment against the intermediate transfer belt 108. At the time of activating a power source or returning from a sleep mode, in some cases, the abutment state may have been changed by an operation by a user or a maintenance operation. Thus, an initialization operation is performed with a monochrome abutment position detection sensor (not shown) to attain the state in which only the process unit 101$k$ is held in abutment against the intermediate transfer belt 108. When a color image is to be formed, the process units 101$y$, 101$m$, and 101$c$ are brought into a state in which all the process units 101$y$, 101$m$, 101$c$, and 101$k$ are held in abutment against the intermediate transfer belt 108 with a color abutment position detection sensor (not shown) similarly to the process unit 101$k$.

An outside environment sensor 203 is a sensor configured to acquire information regarding temperature and humidity outside the image forming apparatus 100. An inside environment sensor 204 is a sensor configured to acquire information regarding temperature and humidity inside the image forming apparatus 100. In this embodiment, the inside environment sensor 204 dedicated to the inside is provided. However, the temperature and humidity inside the image forming apparatus 100 may be calculated with an estimated value based on information from the outside environment sensor 203. A fan 205 is a cooling unit configured to cool heat inside the image forming apparatus 100 by taking in the outside air.

<Explanatory View for Illustrating Operating Portion 330>

Figure 3:
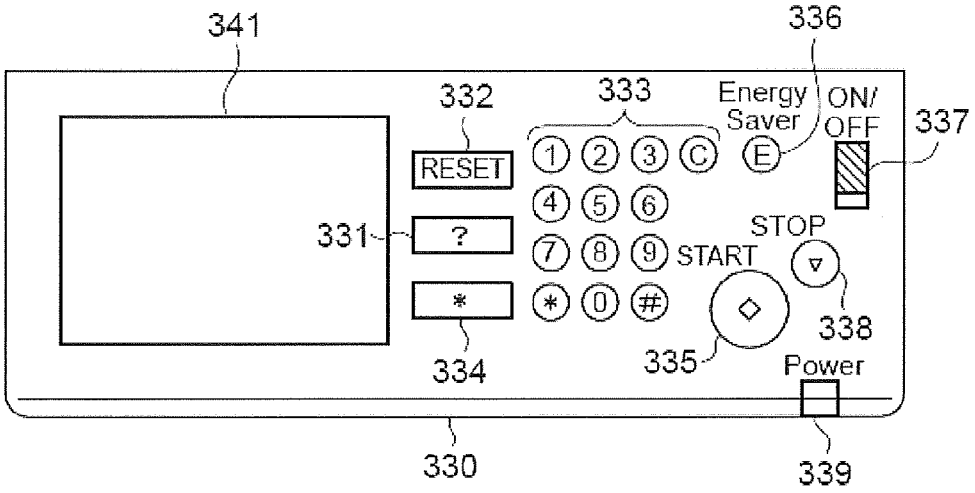
FIG. 3 is an explanatory view for illustrating an operating portion of the image forming apparatus.

FIG. 3 is an explanatory view for illustrating an operating portion 330. The operating portion 330 includes various buttons and a display portion. A power switch 337 is a switch for turning on and off a main power supply for a power supply unit. A power-saving button 336 is a button for shifting a mode of the image forming apparatus to a predetermined power-saving mode and for returning the image forming apparatus in the power-saving mode to a normal mode. A power supply LED 339 emits green light when the main power supply is in an on-state. When a function operated by a user is in operation, the power supply LED 339 emits green light in a blinking manner. Moreover, when an error occurs, the power supply LED 339 emits red light to notify a user of abnormality. A user mode button 334 is a button for setting the image forming apparatus in advance. Numerical keys 333 are keys for inputting numbers such as the number of copies or a FAX destination. A reset key 332 is a key for clearing input values and returning to an initial state of a mode being currently selected. A start button 335 is a key for starting an actual operation based on information input through an operation panel 341 or the numerical keys 333. A stop button 338 is a button for cancelling midway the operation started by the start button 335. A help key 331 is a key for suitably displaying description on a display screen for a user.

The operation panel 341 is a TFT-dot-matrix liquid-crystal panel of a touch panel type. The operation panel 341 is configured to perform operation and display of each mode of a multifunction peripheral and to switch modes.

<Dew Condensation Occurrence Condition>

Figure 4:
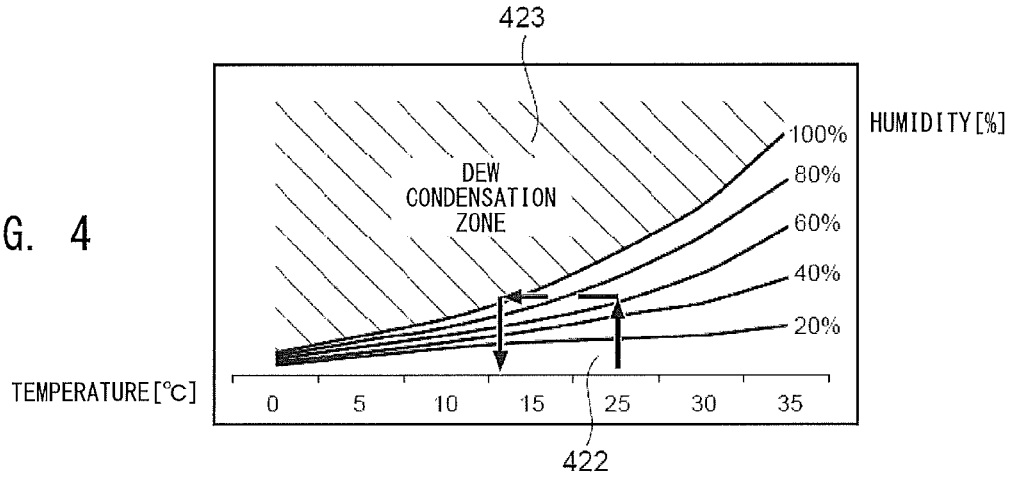
FIG. 4 is an explanatory graph for showing dew condensation occurrence conditions.

FIG. 4 is an explanatory graph for showing dew condensation occurrence conditions. In FIG. 4, there is shown a relationship between outside temperature/humidity acquired by the outside environment sensor 203 and a dew-point temperature.

For example, in an environment (422) with an outside temperature of 25° C. and an outside humidity of 60%, when the temperature is lowered to 13° C., the humidity becomes 100% and enters a dew condensation zone 423. Therefore, a dew-point temperature is 13° C. Thus, a condition which causes dew condensation inside the image forming apparatus in an office environment with an outside temperature of 25° C. and an outside humidity of 60% is a case in which the temperature inside the image forming apparatus acquired by the inside environment sensor 204 is 13° C. Such temperature difference occurs when the outside environment temperature steeply rises while the inside of the image forming apparatus remains in a cooled state.

Figure 5:
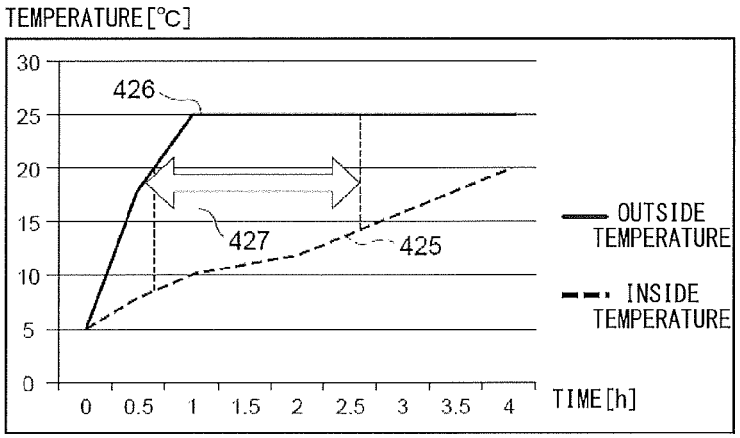
FIG. 5 is an explanatory graph for showing a temperature difference between an outside temperature and an inside temperature during rotation of a fan.

FIG. 5 is a graph for showing a difference between the outside environment temperature and the temperature inside the image forming apparatus. When an outside environment temperature 426 rises from 5° C. to 25° C. in one hour, a temperature 425 inside the image forming apparatus slowly rises in about four hours. There is a section 427 in which a temperature difference between the image forming apparatus and the outside environment temperature is about 12° C. In this section 427, when the fan 205 is rotated at the time of starting image formation and outside air flows into the image forming apparatus, warm outside air is cooled by cool inside air, with the result that dew condensation occurs.

<Dew Condensation Elimination by Toner Application to Photosensitive Drum>

Figure 6:
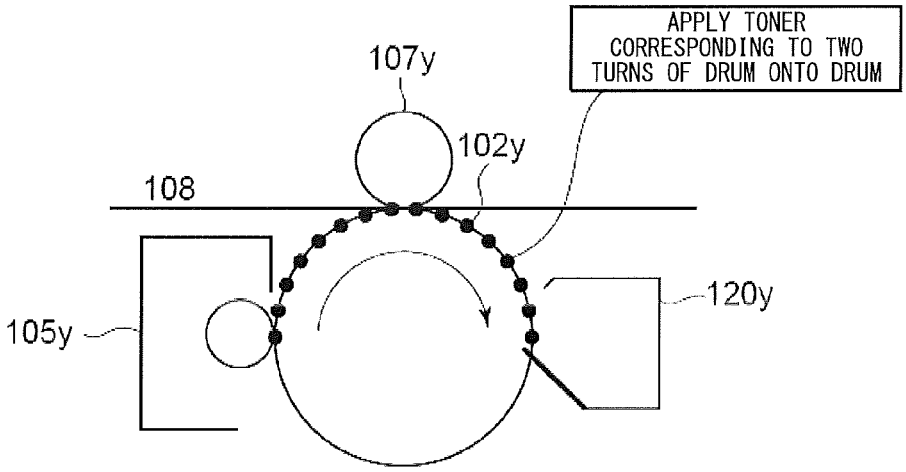
FIG. 6 is an explanatory view for illustrating toner application.

FIG. 6 is an explanatory view for illustrating a dew condensation elimination operation by toner application. In FIG. 6, description is made of an example of using the photosensitive drum 102*y* for yellow (y). The process unit 101*y* includes the developing device 105*y* and a photosensitive drum cleaner 120*y*. The photosensitive drum cleaner 120*y* includes a cleaning blade which is held in contact with the photosensitive drum 102*y*. The toner application of supplying toner onto the charged photosensitive drum 102*y* to form a toner band corresponding to two turns of the drum is performed, and a moisture content caused by dew condensation on the photosensitive drum 102*y* is collected together with toner by the photosensitive drum cleaner 120*y*. With this operation, the dew condensation can be eliminated.

Figure 7A:
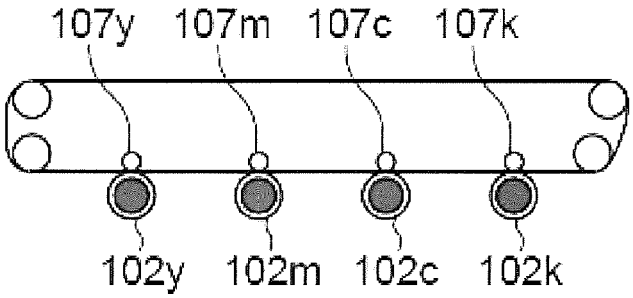
FIG. 7A, FIG. 7B, and FIG. 7C are explanatory views for illustrating toner application modes.
Figure 7B:
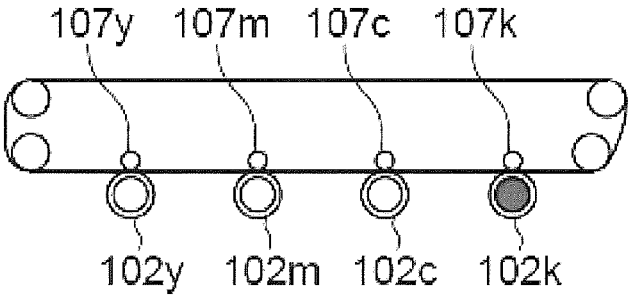
Figure 7C:
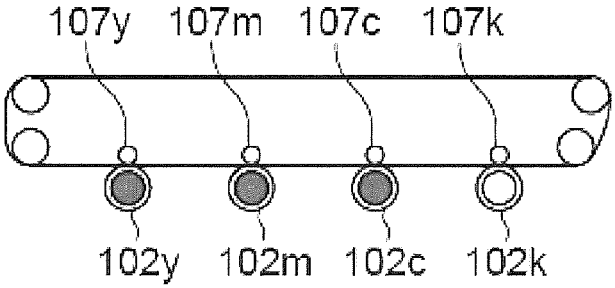

FIG. 7A, FIG. 7B, and FIG. 7C are explanatory views for illustrating operation modes of the dew condensation elimination by toner application. In FIG. 7A, FIG. 7B, and FIG. 7C, the solid photosensitive drums 102*y*, 102*m*, 102*c*, and 102*k* represent drums subjected to toner application.

FIG. 7A is an illustration of an example of a first dew condensation elimination mode. The first dew condensation elimination mode is executed when image formation is to be started in a color image formation mode. The first dew condensation elimination mode is a mode in which dew condensation on the photosensitive drums 102*y* to 102*k* is eliminated by bringing the intermediate transfer belt 108 and the process units 101*y* to 101*k* for all four colors into the abutment state with the separation motor 613 and applying toner to the photosensitive drums 102*y* to 102*k*.

FIG. 7B is an illustration of an example of a second dew condensation elimination mode. The second dew condensation elimination mode is executed when image formation is to be started in a monochromatic image formation mode. The second dew condensation elimination mode is a mode in which dew condensation on the photosensitive drum 102*k* is eliminated by bringing the intermediate transfer belt 108 and only the process unit 101*k* into the abutment state with the separation motor 613 and applying toner to the photosensitive drum 102*k*.

FIG. 7C is an illustration of an example of a third dew condensation elimination mode. The third dew condensation elimination mode is a mode which is executed when the image formation mode is to be changed from the monochromatic image formation mode to the color image formation mode during the image forming operation. The third dew condensation elimination mode is a mode in which dew condensation on the photosensitive drums 102*y*, 102*m*, and 102*c* for colors is eliminated by bringing the intermediate transfer belt 108 and the process units 101*y* to 101*k* into the abutment state and applying toner to the photosensitive drums 102*y*, 102*m*, and 102*c*. In the third dew condensation elimination mode, toner application to the photosensitive drum 102*k* corresponding to black is not performed.

In this embodiment, through the dew condensation elimination by toner application, the dew condensation elimination can be performed in a short period of time but is disadvantageous with regard to the lifetime of the photosensitive drum. Moreover, there is a problem in that toner is consumed. Therefore, in this embodiment, when it is required to eliminate the dew condensation in a short period of time such as in the case in which a start instruction for image formation is received, the dew condensation elimination operation by the toner application described above is to be performed. When the start instruction for image formation is received, any one of the first to third dew condensation elimination modes is to be executed in accordance with an image formation mode. During a period in which the start instruction for image formation is not received, the dew condensation may be eliminated by eliminating the temperature difference between the inside and the outside through rotational drive of the fan 205 to take in the outside air. The dew condensation elimination by the rotation of the fan 205 takes time, but is advantageous in that reduction in lifetime of the photosensitive drum and consumption of toner are prevented.

Further, in this embodiment, through operation of the user mode button 334 by a user, the dew condensation elimination mode can be executed at a timing freely selected by a user.

Figure 10:
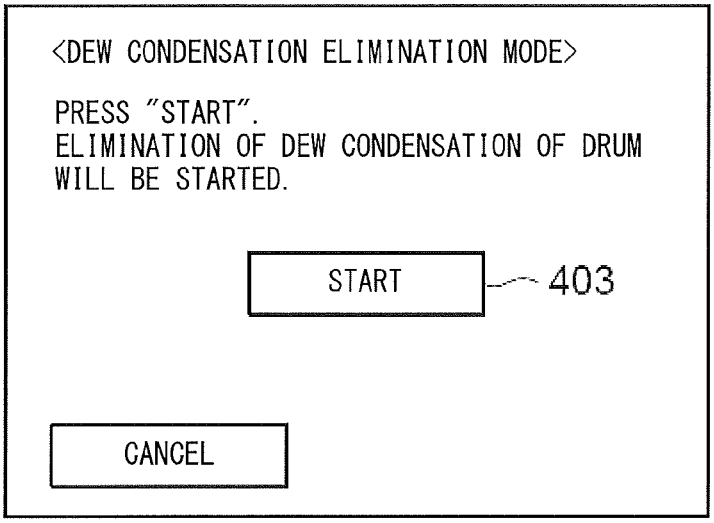
FIG. 10 is an illustration of a manual dew condensation elimination mode screen.

FIG. 10 is an illustration of a manual dew condensation elimination mode screen to be displayed on the operating portion 330. When it is determined that the start button 403 has been selected on the screen of FIG. 10, the CPU 604 executes the dew condensation elimination mode by toner application. In this embodiment, when the instruction for the dew condensation elimination is input from the screen of FIG. 10 displayed on the operating portion 330, the first dew condensation elimination mode is executed. That is, toner application is performed with respect to the photosensitive drums 102 for all colors.

<Description of Flowchart>

Figure 8:
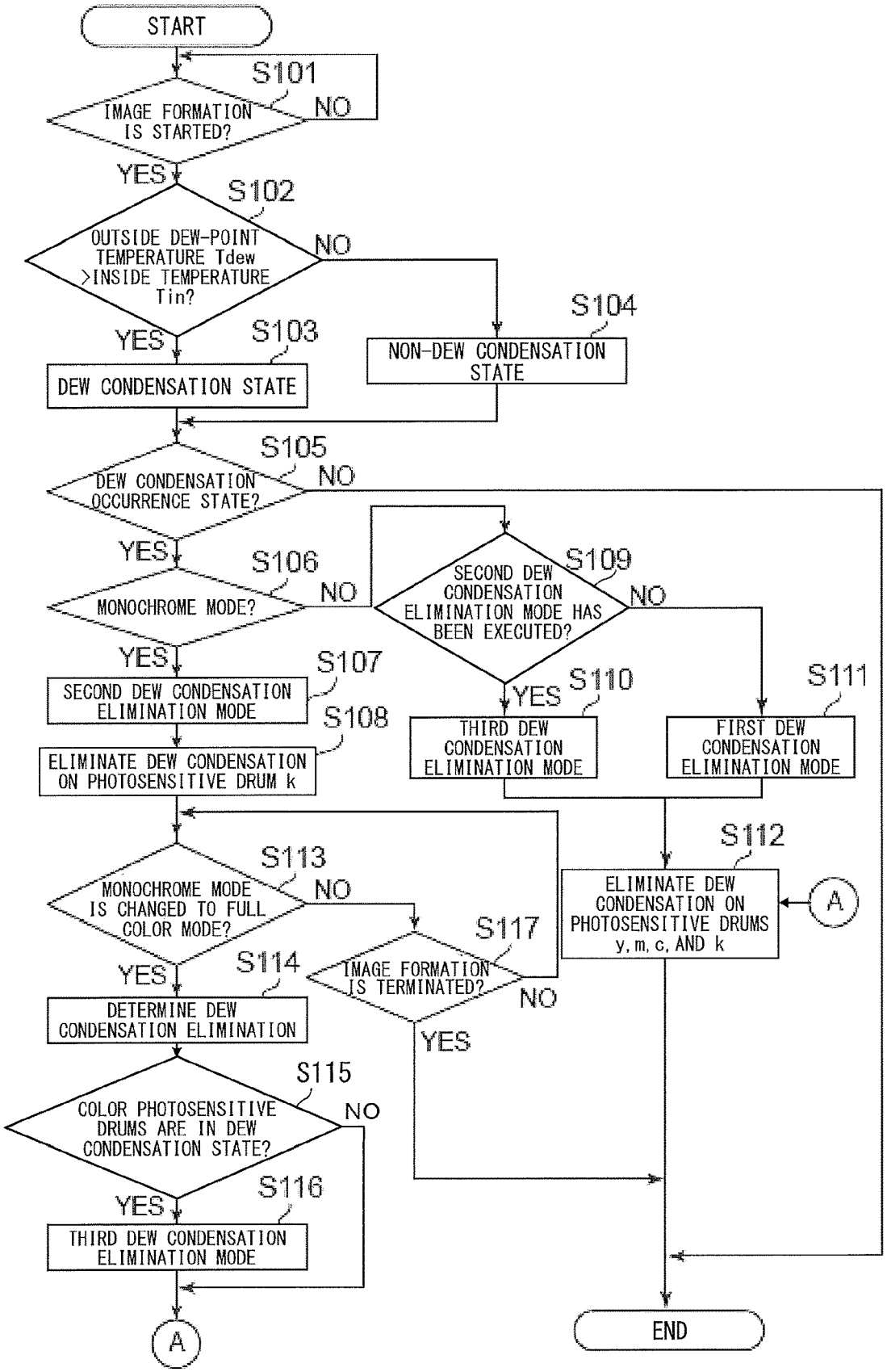
FIG. 8 is a flowchart for illustrating dew condensation elimination control.

FIG. 8 is a flowchart for illustrating the dew condensation elimination operation by toner application. This control is achieved by the CPU 604 executing a control program stored in the ROM 601. First, in Step S101, the CPU 604 receives a start instruction for image formation. When the start instruction for image formation is received, the processing proceeds to Step S102. In Step S102, the CPU 604 compares an outside dew-point temperature Tdew, which is calculated based on the outside temperature and humidity acquired by the outside environment sensor 203, and an inside temperature Tin acquired by the inside environment sensor 204. When the inside temperature Tin is lower than the outside dew-point temperature Tdew, the CPU 604 determines that a dew condensation state of Step S103 is present, and sets an initial value of the toner application amount to the amount corresponding to the two turns of the drum. When the inside temperature Tin is higher than the outside dew-point temperature Tdew, the CPU 604 determines that a non-dew condensation state of Step S104 is present.

In Step S105, the processing proceeds to Step S106 when the dew condensation state is present, whereas the dew condensation elimination control is terminated when the non-dew condensation state is present. When the determination of the presence of the dew condensation state is made in Step S103, it is determined that the dew condensation state is present regardless of the determination results of Step S102 to Step S104 until the dew condensation elimination for all of the photosensitive drums 102 is determined. However, when the image forming operation is not performed in a long period of time (for example, eight hours) after the determination that the dew condensation state is present, there is a possibility that the dew condensation state is changed, and hence the results of the determination processing in Step S102 to Step S104 are selected.

In Step S106, the CPU 604 determines the image formation mode based on the received start instruction for image formation. When the image formation mode is the color image formation mode of using the process units 101*y*, 101*m*, 101*c*, and 101*k*, the processing proceeds to Step S109. When the image formation mode is the monochromatic image formation mode of using only the process unit 101*k*, the processing proceeds to Step S107.

In Step S107, before the image formation is started, the second dew condensation elimination mode is executed. Then, in Step S108, information indicating elimination of the dew condensation on the photosensitive drum 102*k* (dew condensation elimination information) is stored. In Step S109, determination is made on whether or not the second dew condensation elimination mode has already been executed. When the second dew condensation elimination mode has already been executed, it is determined that the dew condensation elimination for the photosensitive drum 102*k* has been executed, and the processing proceeds to Step S110. When the second dew condensation elimination mode has not been executed, the processing proceeds to Step S111. Step S109 is a step of performing the dew condensation elimination only for the photosensitive drum 102*k* after execution of the second dew condensation elimination mode and determining whether or not the photosensitive drums 102*y*, 102*m*, and 102*c* are in the dew condensation state.

In Step S110, the third dew condensation elimination mode is executed to perform the dew condensation elimination for the photosensitive drums 102*y*, 102*m*, and 102*c*. In Step S111, the first dew condensation elimination mode is executed to perform the dew condensation elimination for the photosensitive drums 102*y*, 102*m*, 102*c*, and 102*k* corresponding to all of the colors. In Step S112, the dew condensation elimination information of the photosensitive drums 102*y*, 102*m*, 102*c*, and 102*k* is stored, and the dew condensation elimination control is terminated.

In Step S113, determination is made for every page on whether or not the image formation mode is changed from the monochromatic image formation mode to the color image formation mode. The processing proceeds to Step S117 when there is no change. The processing proceeds to Step S114 when there is a change. In Step S114, determination is made on whether or not dew condensation has been eliminated by the rise in peripheral temperature of the photosensitive drums 102*y*, 102*m*, and 102*c* for colors along with the start of the image forming operation. This determination processing is to be described later with reference to another flowchart.

In Step S115, the processing proceeds to Step S116 when it is determined that the dew condensation state of the photosensitive drums 102*y*, 102*m*, and 102*c* for colors is not eliminated. When the dew condensation state is eliminated, the processing proceeds to Step S112, and the dew condensation elimination control is terminated.

In Step S116, the third dew condensation elimination mode is executed. Then, the processing proceeds to Step S112, and the dew condensation elimination control is terminated. In Step S117, determination is made on whether or not the image formation has been terminated. When the image formation has not been terminated, the processing proceeds to Step S113. When the image formation has been terminated, the dew condensation elimination control flow is terminated under a state in which the dew condensation elimination for the photosensitive drums 102*y*, 102*m*, and 102*c* has not been completed.

As described above, in this embodiment, when the start instruction for image formation is received under a state in which the dew condensation occurs, the dew condensation elimination operation which varies depending on the image formation mode is executed in Step S106. Specifically, when the image formation is to be started in the color image formation mode, the first dew condensation elimination mode is executed. Meanwhile, when the image formation is to be started in the monochromatic image formation mode, the second dew condensation elimination mode is executed. Moreover, when the image formation mode is changed from the monochromatic image formation mode to the color image formation mode after the image formation is started, the third dew condensation elimination mode is executed. Through the dew condensation elimination control described above, reduction in lifetime of the drum and consumption of toner can be suppressed, and dew condensation can be eliminated in the shortest time period at the time of start of the image formation.

Next, description is made of dew condensation elimination by the rise in peripheral temperature of the photosensitive drums 102. The inside temperature of the image forming apparatus 100 rises by the start of driving of the motors and the start of temperature adjustment of the fixing device 117. Therefore, the inside temperature becomes higher than the dew-point temperature given at the time when it is determined that the dew condensation state is present. Thus, the dew condensation state is slowly eliminated, and a state of being higher than the dew-point temperature continues for a predetermined time period, thereby eliminating the dew condensation state.

Figure 9:
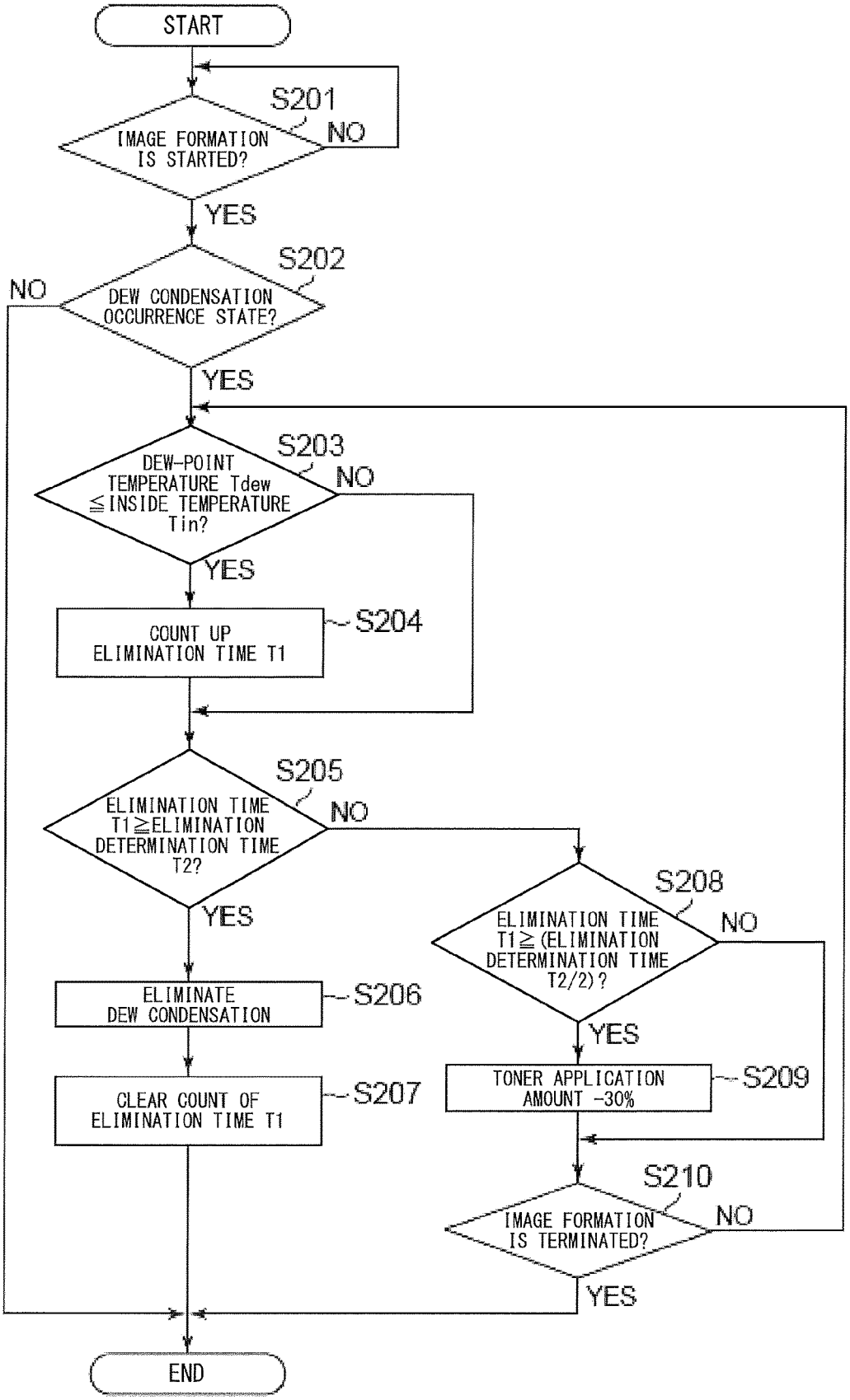
FIG. 9 is a flowchart for illustrating dew condensation elimination determination based on the inside temperature.

FIG. 9 is a flowchart for illustrating a dew condensation elimination operation which is to be performed when the peripheral temperature of the photosensitive drums rises. This control is achieved by the CPU 604 executing the control program stored in the ROM 601. In Step S201, determination of the start of the image forming operation is performed. When the start of the image forming operation is instructed, the processing proceeds to Step S202. In Step S202, determination is made of the dew condensation occurrence state. The determination of the dew condensation occurrence state is the same as the determination result of Step S102. When the dew condensation occurrence state is present, the processing proceeds to Step S203. When the dew condensation occurrence state is not present, the flowchart of FIG. 9 is terminated.

In Step S203, the outside dew-point temperature Tdew calculated in Step S102 and the inside temperature Tin during the image forming operation are compared with one another. When the inside temperature Tin is equal to or higher than the outside dew-point temperature Tdew, the processing proceeds to Step S204, and an elimination time T1 is counted up. When the inside temperature Tin is lower than the outside dew-point temperature Tdew, the processing proceeds to Step S205 without counting up the elimination time T1.

In Step S205, determination is made on whether or not the elimination time T1 is equal to or more than an elimination determination time T2. When the elimination time T1 is equal to or more than the elimination determination time T2, the processing proceeds to Step S206. When the elimination time T1 does not reach the elimination determination time T2, the processing proceeds to Step S208. In Step S206, the peripheral temperature of the photosensitive drums 102 is kept for a certain time period in the state of eliminating the dew condensation. Thus, it is determined that the dew condensation has been eliminated, and the elimination time T1 is cleared in Step S207.

In Step S208, determination is made on whether or not the elimination time T1 corresponding to a half of the elimination determination time T2 has elapsed. When the elimination time T1 corresponding to a half of the elimination determination time T2 has elapsed, in Step S209, the toner application amount determined in Step S103 is changed to a value corresponding to the amount reduced by 30% from the initial value of the amount corresponding to the two turns of the drum. The correction value of 30% is changed depending on the configuration of the image forming apparatus 100. In Step S210, termination of the image forming operation is determined. When the image forming operation is terminated, this control flow is terminated. When the image forming operation is not terminated, the control steps of Step S203 to Step S209 are continuously performed.

As described above, in this embodiment, when the start instruction for image formation is received under the state in which the dew condensation occurs, the dew condensation elimination operation which varies depending on the image formation mode is executed in Step S106. Specifically, when the image formation is to be started in the color image formation mode, the first dew condensation elimination mode is executed. Meanwhile, when the image formation is to be started in the monochromatic image formation mode, the second dew condensation elimination mode is executed. Moreover, when the image formation mode is changed from the monochromatic image formation mode to the color image formation mode after the second dew condensation elimination mode is executed, the third dew condensation elimination mode is executed. Through the dew condensation elimination control described above, the dew condensation elimination is promptly performed through the toner application only for the required photosensitive drum 102, and the toner application is not performed for the photosensitive drum 102 which is not to be used for the image formation.

In particular, when the image formation is to be performed in the monochromatic image formation mode, toner application is performed only for the photosensitive drum corresponding to black. Therefore, consumption of toner can be suppressed. Moreover, for example, wear of the photosensitive drum due to rotation is suppressed, which is also effective for increase in lifetime of a photosensitive member.

Moreover, in this embodiment, even under a state in which the dew condensation occurs, toner application is not performed during a period in which the start instruction for image formation is not received, and the dew condensation elimination by the rise in peripheral temperature of the photosensitive drums 102 is effected. With this, consumption of toner is suppressed.

Moreover, in this embodiment, when the dew condensation elimination mode is executed through operation of the user mode button 334, the first dew condensation elimination mode is executed. With this, the dew condensation on the photosensitive drums corresponding to all of the colors can be eliminated in a short period of time.

Moreover, in this embodiment, after it is determined that the dew condensation occurrence state is present, the time period in which the inside temperature Tin is higher than the dew-point temperature Tdew is counted, and the toner application amount is adjusted in accordance with the counted time period. With this, toner consumption can further be suppressed.

Through the dew condensation elimination control described above, reduction in lifetime of the drum and consumption of toner can be suppressed, and dew condensation can be eliminated in the shortest time period at the time of start of the image formation.

<Other Embodiment>

The present invention can also be achieved by processing of supplying a program that achieves at least one of the functions of the above-mentioned embodiment to a system or an apparatus through a network or a storage medium and then allowing at least one processor of computers in the system or the apparatus to read and execute the program. Moreover, the present invention can also be achieved by a circuit (for example, an ASIC) that achieves at least one of the functions.

As described above, according to the present disclosure, toner consumption can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-233792, filed Dec. 5, 2017, which is hereby incorporated by reference herein in its entirety.

What is claimed is:

1. An image forming apparatus, comprising:

a plurality of photosensitive drums which are configured to bear toner images, the plurality of photosensitive drums including a first photosensitive drum configured to bear a yellow toner image, a second photosensitive drum configured to bear a magenta toner image, a third photosensitive drum configured to bear a cyan toner image, and a fourth photosensitive drum configured to bear a black toner image;

an intermediate transfer belt to which the toner images are transferred from the plurality of photosensitive drums;

a controller configured to determine whether or not a dew condensation occurrence condition is met; and a dew condensation elimination unit configured to perform a dew condensation elimination operation by applying toner to at least one of the plurality of photosensitive drums and collecting the applied toner in a case in which the controller determines that the dew condensation occurrence condition is met and when an instruction for image formation is received, wherein, in a case in which the dew condensation elimination operation is to be performed when the image formation is started in a color image formation mode, the dew condensation elimination unit executes a first dew condensation elimination mode of applying toner to the first photosensitive drum, the second photosensitive drum, the third photosensitive drum, and the fourth photosensitive drum, wherein, in the case in which the dew condensation elimination operation is to be performed when the image formation is started in a monochromatic image formation mode, the dew condensation elimination unit executes a second dew condensation elimination mode of applying toner to the fourth photosensitive drum without applying toner to the first photosensitive drum, the second photosensitive drum, and the third photosensitive drum, and wherein, when an image formation mode is changed from the monochromatic image formation mode to the color image formation mode after the image formation is started, the dew condensation elimination unit executes a third dew condensation elimination mode of applying toner to the first photosensitive drum, the second photosensitive drum, and the third photosensitive drum, without applying toner to the fourth photosensitive drum.

2. The image forming apparatus according to claim 1, further comprising an actuator configured to control abutment and separation of the intermediate transfer belt and the plurality of photosensitive drums, wherein, in a case in which the image formation mode is the monochromatic image formation mode, the actuator brings the intermediate transfer belt into abutment with the fourth photosensitive drum and not into abutment with any of the first photosensitive drum, the second photosensitive drum, and the third photosensitive drum, and wherein, in a case in which the image formation mode is the color image formation mode, the actuator brings the intermediate transfer belt into abutment with each of the first photosensitive drum, the second photosensitive drum, the third photosensitive drum, and the fourth photosensitive drum.

3. The image forming apparatus according to claim 2, wherein the first dew condensation elimination mode is a mode of bringing the intermediate transfer belt into abutment with the plurality of photosensitive drums to which toner is to be applied, and wherein the second dew condensation elimination mode is a mode of bringing the intermediate transfer belt into abutment with the fourth photosensitive drum to which toner is to be applied without bringing the intermediate transfer belt into abutment with the first photosensitive drum, the second photosensitive drum, and the third photosensitive drum.

4. The image forming apparatus according to claim 1, wherein the controller determines whether or not the dew condensation occurrence condition is met based on temperature and humidity outside the image forming apparatus, the temperature and humidity being acquired from an external environment sensor.

5. The image forming apparatus according to claim 4, wherein the controller calculates a dew-point temperature based on the temperature and the humidity acquired from the external environment sensor, and wherein, in a case in which an inside temperature acquired from an internal environment sensor is lower than the calculated dew-point temperature, the controller determines that the dew condensation occurrence condition is met.

6. The image forming apparatus according to claim 5, wherein, in a case in which a predetermined time period has elapsed after the inside temperature becomes higher than the dew-point temperature, the controller determines that the dew condensation has been eliminated.

7. The image forming apparatus according to claim 1, wherein the dew condensation elimination unit controls an application amount of toner in accordance with a time period from when the dew condensation occurrence condition is met until reception of the instruction for image formation.

8. The image forming apparatus according to claim 1, further comprising a fan configured to take in outside air, wherein, in a case in which the controller determines that the dew condensation occurrence condition is met, and during a period in which the instruction for image formation is not received, the dew condensation elimination operation is performed by rotation of the fan without toner application to the plurality of photosensitive drums.

9. The image forming apparatus according to claim 1, further comprising an operation panel configured to receive a user instruction, wherein, in a case in which an instruction for dew condensation elimination is input from the operation panel, the dew condensation elimination unit executes the first dew condensation elimination mode.

* * * * *